United States Patent [19]

Brotzmann

[11] 4,348,227

[45] Sep. 7, 1982

[54] PROCESS FOR PRODUCING STEEL WITH LOW HYDROGEN CONTENT IN A THROUGH-BLOWING OXYGEN CONVERTER

[75] Inventor: Karl Brotzmann, Sulzbach-Rosenberg, Fed. Rep. of Germany

[73] Assignee: Eisenwerk-Gesellschaft Maximilianshutte mbH, Sulzbach-Rosenberg, Fed. Rep. of Germany

[21] Appl. No.: 172,008

[22] Filed: Jul. 24, 1980

[30] Foreign Application Priority Data

Aug. 7, 1979 [DE] Fed. Rep. of Germany ..... 2931957

[51] Int. Cl.[3] ..... C21C 5/32; C21C 5/34

[52] U.S. Cl. ..... 75/60; 75/51; 75/52; 75/59

[58] Field of Search ..... 75/59, 60, 51, 52

[56] References Cited

U.S. PATENT DOCUMENTS

| | | | |
|---|---|---|---|
| 3,854,932 | 12/1974 | Bishop | 75/60 |
| 3,953,199 | 4/1976 | Michaelis | 75/60 |
| 4,089,677 | 5/1978 | Spenceley | 75/60 |
| 4,178,173 | 12/1979 | Gorges | 75/60 |

*Primary Examiner*—P. D. Rosenberg
*Attorney, Agent, or Firm*—Lawrence I. Field

[57] ABSTRACT

In a process for the production of steel with low hydrogen content in a through-blowing oxygen converter with nozzles arranged below the bath surface in the refractory brick lining, the nozzles composed of concentric pipes for introducing oxygen sheathed by a protective medium, and with an oxygen lance projecting into the converter opening, for a hydrogen content as low as possible of about 2 ppm maximum, at least half the total quantity of oxygen is blown onto the bath and the nozzles arranged below the bath surface are temporarily operated toward the termination of refining with a hydrogen-free gas.

4 Claims, No Drawings

PROCESS FOR PRODUCING STEEL WITH LOW HYDROGEN CONTENT IN A THROUGH-BLOWING OXYGEN CONVERTER

The invention relates to a process for producing steel with low hydrogen content in a converter which, in addition to the oxygen inlet nozzles sheathed with a protective medium and arranged underneath the bath surface, is also provided with oxygen top blowing devices above the bath surface.

In the production of steel in the oxygen converter, the inlet nozzles in the refractory brick lining of the converter are protected against premature scaling loss by means of hydrocarbons. The nozzle usually is composed of two concentric pipes. Oxygen flows through the central pipe and gaseous or liquid hydrocarbons for the protection of the nozzles are introduced through the annular gap between the two pipes. The quantity of hydrocarbons required for the protection of the nozzles usually is below 10% by weight relative to the oxygen.

The hydrocarbons used and the water of the hydration in the powdered lime with which the refining oxygen is charged as a slag-forming material lead to an increased hydrogen concentration which is undesirable in some steel grades.

When refining pig iron which is low in phosphorus, the hydrogen content of the finished steel is up to 5 ppm; when using pig iron grades which are richer in phosphorus, the content is approximately 2 ppm higher. In relation to the quantity of hydrogen introduced below the bath surface, this hydrogen content present in the steel is relatively small. A major portion of the hydrogen formed from the hydrocarbons is rinsed out by the carbon monoxide formed during the refining of steel. The rinsing effect also explains why the final hydrogen content is higher when refining pig iron which is high in phosphorus than when refining pig iron which is low in phosphorus. During the removal of phosphorus which preferably is done during the last stage of blowing, relatively small amounts of gaseous reaction products are formed for the rinsing of the hydrogen.

For certain steel grades, it is required to reliably obtain low hydrogen contents of about 2 ppm and lower. With the increasing introduction of the continuous casting technology, the share of steel grades with low hydrogen content of about 2 ppm has also increased.

The British Pat. No. 1,253,581 which relates to the through-blowing oxygen method, describes the possibility for the reduction of high hydrogen contents of rinsing for a short period (30 to 60 seconds) with nitrogen or argon in order to reduce the hydrogen content by about 50%. The hydrogen reduction of 50% refers to high initial hydrogen contents which occur when hydrogen is used as the medium for protecting the nozzles. In practice, the rinsing time is usually 1 to 2 minutes. The rinsing gas is usually nitrogen, and argon is used for steel grades with low final nitrogen content. During the rinsing treatment, the quantities of rinsing gas used are from 2 to 3 $Nm^3$ per minute and ton of steel. This rinsing treatment leads to a temperature loss of about 10° C./min, i.e. 20° C. when after-blowing for two minutes. Accordingly, the disadvantages are the expenses for the rinsing gas, particularly argon, and the temperature loss which corresponds approximately to a reduction of the scrap melting capacity of about 10 kg/t steel.

The U.S. Pat. No. 3,953,199 corresponding to German Pat. No. 24 05 351, describes a modified top-blowing oxygen process, wherein, toward the end of refining when the carbon content of the melt is between 0.2 to 0.05%, oxygen is supplied to the bath through bottom nozzles in a quantity which is increased by up to 50% in order to obtain low final carbon contents in the steel and low iron oxide contents in the slag. The lower hydrogen content compared to the through-blowing oxygen process is recited as a further advantage of this known process. However, the required increase of the oxygen blow rate through the bottom nozzles toward the end of refining also leads to an increased supply of hydrocarbons for the protection of the nozzles and low final hydrogen contents in the steel can no longer be obtained with certainty.

Furthermore, in the German patent application No. P 27 55 165 which is not yet published it is described to blow oxygen in accordance with the through-blowing oxygen method from below and simultaneously to blow oxygen onto the bath. This process serves especially for increasing the addition of scrap and has the additional advantage that it is possible to reduce the number of nozzles below the bath surface. The lower number of nozzles below the bath surface means a lower consumption of the medium for protecting the nozzles which, in turn, leads to lower hydrogen contents in the finished steel compared to the pure through-blowing oxygen process. The patent application referred to above mentions a hydrogen content in the order of magnitude of 4 ppm in the through-blowing oxygen process and an average of 3 ppm. This reduction of the hydrogen concentration in the finished steel is a result of the decrease in the amount of hydrocarbons used for the protection of the nozzles.

The object of the present invention resides in producing as economically as possible steel with a low hydrogen content in a through-blowing oxygen converter constituting a further development of the German patent application P 27 55 165 and in maintaining the known advantages of the through-blowing oxygen process, particularly the reliably controllable refining procedure, the low final carbon contents, the low iron oxide content of the tapping slag, the safe and increased scrap melting capability and the high yield.

The invention meets this object thereby that, for obtaining hydrogen contents in the steel of approximately 2 ppm and less, at least half of the total quantity of oxygen is blown onto the bath and the nozzles below the bath surface are operated for a short period toward the end of refining with gases which are free of hydrogen.

In the process according to the invention, at least 50% of the total quantity of oxygen are blown onto the bath with an approximately constant flow rate until the end of refining. The quantity of oxygen which is supplied to the melt from the top is preferably high in relation to the total refining oxygen and is about $\frac{2}{3}$ of the total quantity of oxygen. The top blown oxygen portion can also be higher and may be about 85%, in special cases even 90%, of the total quantity of oxygen supplied to the melt in the converter.

While the conventional bottom nozzles of two concentric pipes or the so-called annular slot nozzles in accordance with German Pat. No. 24 38 142 are usually used below the bath surface, the oxygen is blown in from the top in the conventional manner through lances or side nozzles which are installed in the upper converter region of the refractory brick lining and are approximately directed toward the bath center. Hydrocarbons are also used for the protection of the side nozzles arranged in the brick lining of the converter, however, the quantities required are only about 10% compared to the hydrocarbon rate used for the protection of the bottom nozzles. The quantities of hydrogen supplied in this manner through the side nozzles are generally so small that they are negligible. It is within the scope of the invention, in melts with extremely low final hydrogen contents, to also operate the side nozzles with inert gas instead of hydrocarbon in the last refining phase.

The preferred application of the process in accordance with the invention resides in reducing the number of the nozzles below the bath surface compared to a conventional through-blowing oxygen converter to less than half and to blow onto the bath about $\frac{2}{3}$ of the quantity of oxygen supplied to the melt in the time unit. In the through-blowing oxygen converters, side nozzles are preferably used as the top-blowing devices, and in top-blowing oxygen converters equipped with bottom nozzles, primarily the water-cooled lance for blowing the oxygen from the top is retained.

In accordance with the invention, the free cross-sectional area for blowing oxygen is dimensioned, in dependence upon the oxygen inlet pressure for the top-blowing device and the nozzles below the bath surface, in such a ratio that 50 to 90%, preferably about $\frac{2}{3}$, of the oxygen flow rate are blown onto the melt. The adjusted oxygen blowing rates are held approximately constant during the entire refining period. Of course, slight deviations from these blow rates below and above the bath surface, for example, by charging the oxygen with slag-forming materials, are within the scope of the invention. On the other hand, significant increases of the oxygen supply through the bottom nozzles toward the termination of refining are to be avoided because this has as a consequence an increased hydrocarbon flow for the protection of the nozzles which, in turn, may lead to increased hydrogen contents in the steel. In accordance with the invention, especially toward the termination of refining when the CO development in the melt is reduced, the supply of hydrocarbons is to be limited to the necessary minimum and is to be completely avoided in the last 0.1 to 2 minutes of the refining period.

The conventional measure of decreasing the hydrogen content by means of a rinsing gas treatment through the bottom nozzles has, as already mentioned, economic disadvantages. About 2 to 3 $Nm^3$/min and ton of steel of rinsing gas must be used. In a 60 ton converter, rinsing is performed for about 2 minutes with a nitrogen or argon blowing rate of about 10,000 $Nm^3$/h in order to adjust hydrogen contents in the steel of about 2 ppm. Aside from the costs for the rinsing medium and the temperature loss which leads to a reduction of the addition of scrap while the tapping temperature remains the same, the rinsing gas treatment of about 2 minutes and more has a disadvantageous effect on the wear of the nozzles, and this leads to an increased consumption of the refractory brick lining of the bottom. Moreover, the increased rate of wear of the refractories of the converter bottoms leads to an undesirable reduction of the efficiency in the production of steel.

The nozzles in a through-blowing oxygen converter normally have accretions of about 150 mm diameter which slightly protrude above the level of the refractory lining of the bottom. The accretions are formed in the shape of mushrooms over the duct for the nozzle protection medium and extend further outwardly, while the central oxygen supply pipe remains free. After a rinsing gas treatment of about 2 minutes, these nozzle accretions are hardly noticeable. The nozzles are subject to a slight partial scaling loss and, in dependence on the temperature of the melt, are recessed in the brick lining of the bottom by up to 5 cm. The melting or the scaling loss of the nozzle accretions is the reason for the increased wear of the nozzles and the bottom.

The process in accordance with the invention avoids the scaling loss of the nozzles and, thus, the increased wear of the brick lining of the bottom. The nozzle accretions are normally reduced only slightly and a reduction of the nozzle accretion can be observed only toward the end of the about 2 minutes of the blowing time with the hydrogen-free gases. However, the nozzle accretion regenerates, i.e. it grows to the usual size, during the next melt, as soon as hydrocarbons are again introduced for the protection of the nozzles.

The process in accordance with the invention is preferably carried out in such a way that $\frac{2}{3}$ of the quantity of the refining oxygen is blown onto the bath and the remaining oxygen is supplied to the melt through the nozzles below the bath surface. With the blow rate for the nozzles below the bath surface remaining approximately constant, they are switched to a hydrogen-free gas toward the termination of refining, i.e., about 0.1 to 2 minute prior to tapping. The main flow of the nozzles, i.e. the gas flow through the central pipe in nozzles of two concentric pipes or through the annular gap for oxygen in annular slot nozzles, is fed with oxygen, mixtures of oxygen and nitrogen, air, $CO_2$ and/or inert gas, e.g. argon, but with approximately the same or a lower flow rate than for the refining oxygen. Through the annular gap for the protective medium, there are conducted either nitrogen, CO, $CO_2$, inert gases, e.g. argon, or mixtures thereof. When oxidizing gases are used in the main flow, the refining effect can be maintained in such a way that only slight or no additional temperature losses are caused by introducing the hydrogen-free gases.

When inert gases are used, preferably argon, particularly for the production of steel grades with low nitrogen contents, the blowing period in accordance with the present invention is about 30 seconds in order to safely adjust the desired final hydrogen contents in the steel of 2 ppm and less. The argon consumption is then about 0.5 $m^3$/t steel. This low argon consumption constitutes a significant economic advantage over the known rinsing gas treatment.

In accordance with the invention, prior to operating temporarily toward the termination of refining with hydrogen-free gases below the bath surface, additional measures for reducing the hydrogen absorption in the steel can be taken. For example, one of these measures is the operation of the nozzles below the bath surface with a minimum addition of hydrocarbons for the nozzle protection, e.g. in the order of magnitude of 2 to 3% by weight relative to the oxygen. Furthermore, as another example, the lime supplied through the bottom nozzles for the formation of slag can be specifically pretreated, for example, dried in order to remove the water of hydration.

In the following, the invention is described in more detail with the aid of non-restricting examples.

In a 60 ton converter with a free converter volume of about 55 $m^3$ in the newly lined state, there are four nozzles in the brick lining of the bottom. As is conventional, the nozzles consist of two concentric pipes. In the upper converter cone, about 3 m above the bath surface, two side nozzles are mounted in the refractory lining. The inclination of the side nozzles is aligned in such a way that the emerging oxygen jets are directed approximately toward the center of the bath surface. The cross-sectional area for oxygen blowing of the four bottom nozzles is about 18 $cm^2$ and that of the two side nozzles is 48 $cm^2$.

This converter is charged with about 22 tons of scrap and 45 tons of pig iron with an analysis of 3.5% carbon, 0.7% silicon, 1% manganese, 1.8% phosphorus. The bottom nozzles are operated with a blow rate of about 5000 $Nm^3/h$ oxygen and the side nozzles are operated with about 11,000 $Nm^3/h$ oxygen. 120 $Nm^3/h$ propane are used for the protection of the bottom nozzles, and the corresponding propane blowing rate for the side nozzles is 50 $Nm^3/h$.

After a principal blowing period of about 10 minutes, the slag is tapped from the converter and a steel sample is taken for analysis. In accordance with this analysis, after-blowing is performed for about 2 minutes with about the same blowing rate for the bottom and side nozzles as during the principal blowing period. During the last 0.5 minutes, the bottom nozzles operate with air in the main flow and $N_2$ in the annular gap. The side nozzles are operated with oxygen until the converter is tilted to the tapping position. After a total time of 2.5 minutes for after-blowing, the steel is tapped from the converter with an analysis of 0.02% carbon, 0.1% manganese, 0.020% propane, 30 ppm nitrogen and 1.5 ppm hydrogen.

In another charge with otherwise the same procedure as in the above example, the bottom nozzles are operated in the last 0.3 minutes of the after-blowing period with argon in the main flow and in the annular gap. Compared to the above-mentioned analysis, the steel tapping has an analysis with a nitrogen content of 15 ppm and a hydrogen content of 1.5 ppm.

A redesigned 150 ton top-blowing oxygen converter which has a lance device is equipped with six bottom nozzles. This converter is charged with 45 tons of scrap and 120 tons of pig iron. The pig iron is a low-phosphorous pig iron of the composition 4.4% carbon, 1.0% silicon, 0.8% manganese, 0.1% phosphorus. About 80% of the total quantity of oxygen is supplied to the melt through the lance, and the remainder flow through the bottom nozzles. The total amount of hydrocarbons for the protection of the bottom nozzles is 90 kg. 100 $m^3$ nitrogen are introduced through the bottom nozzles during the last 0.8 blowing minutes. The tapping analysis of the steel shows a hydrogen content of 1.8 ppm.

In a special case, in which the above-mentioned 150 ton top-blowing oxygen converter has only two nozzles in the converter bottom, only 10% of the total quantity of oxygen are supplied to the melt in the converter through these bottom nozzles. In this case, the quantity of hydrocarbons for the protection of the nozzles is 25 kg. The charged scrap and pig iron correspond to the preceding example with respect to amounts and analysis. In the last blowing minute, 60 $Nm^3$ carbon dioxide were introduced through the two bottom nozzles. The steel tapped from the converter had a hydrogen content of 1.7 ppm and a nitrogen content of 19 ppm.

The same 60 ton converter as described in the first example is equipped, instead of the bottom nozzles, with two side nozzles below the bath surface. The side nozzles are mounted about 0.3 m above the bottom in the refractory brick lining of the side wall of the converter and have the same free cross-sectional area for blowing oxygen as the four bottom nozzles mentioned in the first example.

The additions charged to the converter and the oxygen blow rates below and above the bath surface also correspond to the mentioned example, except that the hydrocarbon quantity for the protection of the nozzles in the side walls below the bath surface was increased to about 180 $Nm^3/h$. As a result of this procedure, the nozzle accretion after the principal blowing period increases to about 200 mm diameter and protrudes above the brick wall lining by about 5 cm. The hydrogen content of the melt after the principal blowing period is about 3.5 ppm, while it is about 3 ppm in the first example. The same tapping analysis is achieved by a blowing period of one minute with hydrogen-free gases, namely air in the main flow and nitrogen in the annular gap, through the nozzles below the bath surface. As in the first example, the hydrogen content is 1.5 ppm; the nitrogen content is slightly increased and is 35 ppm. The nozzle accretions have been reduced to a diameter of 100 mm during the after-blowing period with hydrogen-free gases and, by estimate, protrude 1 cm above the converter brick lining.

In the production of steel with low hydrogen content according to the invention, it has been found advantageous to use carbon dioxide ($CO_2$) for the blowing period at the end of the refining procedure for 0.1 to 2 minutes with hydrogen-free gases. Especially when the oxygen duct (main flow) of the bottom nozzles is further operated with oxidizing gas, preferably oxygen, and a hydrogen-free gas is used only in the annular gap instead of the hydrocarbons, carbonic acid has been found more favorable than argon and nitrogen, primarily because small amounts are sufficient for the protection of the nozzles in relation to the oxygen. While about 40 to 50% by volume of argon or nitrogen relative to the oxygen are required for a sufficient protection of the nozzles, 20 to 30% by volume of carbon dioxide are surprisingly enough. Moreover, during this blowing period with hydrogen-free gases, the nozzle accretions do not go back as strongly when carbon dioxide is used as is the case when blowing with nitrogen and argon. Furthermore, the use of carbonic acid ($CO_2$) as well as the use of argon does not lead to an increase of the nitrogen concentration in the steel during the mentioned blowing period at the end of the refining procedure. However, the heat consumption is higher when carbon dioxide is used, because, in addition to heating the gas quantities used, there is the energy of dissociation ($CO_2 = CO + O$).

The 60 ton converter already described with respect to Example 1 is charged with the same additions (22 tons of scrap and 45 tons of pig iron of the above-mentioned composition). Moreover, the same oxygen top-blowing and through-blowing rates are employed. The blowing rate of propane for the protection of the bottom nozzles is 80 $Nm^3/h$. In the last 50 seconds of the total refining period, i.e. during the after-blowing period and during tilting of the converter into the tapping position, the bottom nozzles in the main flow are further operated with oxygen of the above-mentioned blowing rate of 5000 $Nm^3/h$. $CO_2$ is conducted with a blowing rate of about 1000 $Nm^3/h$ through the annular gaps of the four bottom nozzles. In the analysis, the tapped steel has a nitrogen concentration of 17 ppm and a hydrogen content of 1.6 ppm.

The same converter has also been operated with lower oxygen blowing rates through the bottom nozzles. In this case, only two nozzles are mounted in the converter bottom, with 2000 $Nm^3/h$ oxygen flowing through the nozzles, while about 17,000 $Nm^3$ per hour oxygen are blown onto the bath through the two side nozzles above the bath surface whose cross-sectional areas are enlarged. For the protection of the bottom nozzles, propane is used with a blowing rate of 45 $Nm^3/h$ during the refining period and 500 $Nm^3/h$ $CO_2$ are used in the last 0.8 minutes.

Compared to argon, the use of carbon dioxide proves especially economical because only about half the amount of gas relative to the oxygen is required for a sufficient protection of the nozzles. The metallurgical results, primarily the low hydrogen content and no additional nitrogen absorption, are about the same in these two hydrogen-free gases which are used in the last refining phase of approximately 0.1 to 2 minutes.

I claim:

1. A process for producing steel with low hydrogen content in a convertor in which a molten iron bath is refined (1) by means of oxygen introduced into the bath by means of nozzles located below the bath surface, said oxygen being introduced together with a sheathing of a protective medium and (2) means of oxygen introduced into the bath by oxygen blowing devices located above the bath surface, which comprises the following improved procedure to insure production of a steel having a hydrogen content of about 2 ppm or less:

introducing at least half of the quantity of oxygen required for refining by blowing the same onto the bath and operating the nozzles located below the surface of the bath with hydrogen free gases as the protective medium during the final 0.1 to 2 minutes of the refining procedure.

2. Process according to claim 1, characterized in that oxidizing gases, air, $CO_2$, CO, nitrogen, inert gases, argon and mixtures thereof are used as hydrogen-free gases.

3. Process according to claim 1, characterized in that the main flow and the gas flow in the jacket of the nozzles below the bath surface are supplied with different hydrogen-free gases.

4. Process according to claim 1, characterized in that the main flow and the gas flow in the jacket of the nozzles below the bath surface are supplied with the same hydrogen-free gases.

* * * * *